US010965030B2

(12) United States Patent
Han et al.

(10) Patent No.: US 10,965,030 B2
(45) Date of Patent: Mar. 30, 2021

(54) ANTENNA APPARATUS

(71) Applicant: Samsung Electro-Mechanics Co., Ltd., Suwon-si (KR)

(72) Inventors: Myeong Woo Han, Suwon-si (KR); Nam Ki Kim, Suwon-si (KR); Dae Ki Lim, Suwon-si (KR); Ju Hyoung Park, Suwon-si (KR); Jeong Ki Ryoo, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 90 days.

(21) Appl. No.: 16/185,350

(22) Filed: Nov. 9, 2018

(65) Prior Publication Data

US 2019/0334241 A1 Oct. 31, 2019

(30) Foreign Application Priority Data

Apr. 30, 2018 (KR) ..... 10-2018-0049532
Jun. 29, 2018 (KR) ..... 10-2018-0075308

(51) Int. Cl.
*H01Q 9/04* (2006.01)
*H01Q 1/52* (2006.01)
*H01Q 1/36* (2006.01)

(52) U.S. Cl.
CPC ..... *H01Q 9/0414* (2013.01); *H01Q 1/36* (2013.01); *H01Q 1/521* (2013.01); *H01Q 1/526* (2013.01); *H01Q 9/045* (2013.01)

(58) Field of Classification Search
CPC ..... H01Q 1/526; H01Q 9/0414
See application file for complete search history.

(56) References Cited

U.S. PATENT DOCUMENTS 8,044,863 B2 * 10/2011 Ali ..... H01Q 9/42 343/700 MS
9,799,959 B2 * 10/2017 Ko ..... H01Q 9/045
10,651,557 B2 * 5/2020 Ying ..... H01Q 9/0414
10,879,592 B2 * 12/2020 Ying ..... H01Q 1/243
(Continued)

FOREIGN PATENT DOCUMENTS

JP 4918534 B2 4/2012
KR 10-2016-0016465 A 2/2016
KR 10-2018-0017667 A 2/2018

OTHER PUBLICATIONS

Li et al.; A Multibeam End-Fire Magnetoelectric Dipole Antenna Array for Millimeter-Wave Applications; IEEE Transactions on Antennas and Propagation, vol. 64, No. 7, Jul. 2016 (Year: 2016).*
(Continued)

*Primary Examiner* — Ab Salam Alkassim, Jr.
(74) *Attorney, Agent, or Firm* — NSIP Law

(57) ABSTRACT

An antenna apparatus includes: a ground layer; a feed line disposed in a position lower than a position of the ground layer; and an antenna structure including a first radiation part connected to one end of the feed line and configured to provide a first electromagnetic plane in a first direction, and a second radiation part connected to the first radiation part, configured to provide a second electromagnetic plane in a second direction, and disposed such that at least a portion of the second radiation part is disposed in a position higher than the position of the ground layer.

21 Claims, 14 Drawing Sheets

(56) References Cited

U.S. PATENT DOCUMENTS

2010/0127938 A1* 5/2010 Ali ..... H01Q 1/243 343/700 MS
2013/0207869 A1* 8/2013 Han ..... H01Q 9/0407 343/848
2015/0155617 A1* 6/2015 Liou ..... H01Q 1/243 343/702
2016/0043470 A1* 2/2016 Ko ..... H01Q 21/24 343/843
2016/0211586 A1* 7/2016 Hong ..... H01Q 15/0086
2016/0344093 A1* 11/2016 Tagi ..... H01Q 1/38
2017/0018845 A1* 1/2017 Lee ..... H01Q 1/521
2018/0048075 A1 2/2018 Park et al.
2019/0123425 A1* 4/2019 Jeong ..... H01Q 9/28
2019/0198995 A1* 6/2019 Ryoo ..... H01L 24/20
2019/0273320 A1* 9/2019 Kim ..... H01Q 9/045
2019/0288377 A1* 9/2019 Ying ..... H01Q 1/243
2019/0305432 A1* 10/2019 Kim ..... H01Q 9/0414
2019/0326674 A1* 10/2019 Kang ..... H01L 24/13
2020/0091599 A1* 3/2020 Nakamura ..... H01Q 1/2283
2020/0220268 A1* 7/2020 Kim ..... H01Q 21/28
2020/0303839 A1* 9/2020 Kim ..... H01Q 1/36
2020/0313300 A1* 10/2020 Ying ..... H01Q 9/0457
2021/0036433 A1* 2/2021 Kim ..... H01Q 1/48

OTHER PUBLICATIONS

Park, Junho et al., "28 GHz 5G Dual-Polarized End-fire Antenna with Electrically-Small Profile", *12th European Conference on Antennas and Propagation* (*EuCAP 2018*), London UK, Apr. 9-13, 2018 (4 pages in English).

Korean Office Action dated Apr. 29, 2019 in counterpart Korean Patent Application No. 10-2018-0075308 (6 pages in English and 5 pages in Korean).

* cited by examiner

ANTENNA APPARATUS

CROSS-REFERENCE TO RELATED APPLICATIONS

This application claims benefit under 35 U.S.C. § 119(a) of Korean Patent Application No. 10-2018-0049532 filed on Apr. 30, 2018 and Korean Patent Application No. 10-2018-0075308 filed on Jun. 29, 2018, in the Korean Intellectual Property Office, the entire disclosures of which are incorporated herein by reference for all purposes.

BACKGROUND

1. Field

The following description relates to an antenna apparatus.

2. Description of Related Art

Data traffic of mobile communications is increasing rapidly every year. Technological development is underway to support the transmission of such rapidly increased data in real time in wireless networks. For example, the contents of internet of things (IoT) based data, augmented reality (AR), virtual reality (VR), live VR/AR combined with SNS, autonomous navigation, applications such as Sync View (real-time video transmissions of users using ultra-small cameras), and the like may require communications (e.g., 5G communications, mmWave communications, etc.) supporting the transmission and reception of large amounts of data.

Recently, millimeter wave (mmWave) communications, including $5^{th}$ generation (5G) communications, have been researched, and research into the commercialization/standardization of an antenna apparatus capable of smoothly implementing such communications is progressing.

Since RF signals in high frequency bands (e.g., 24 GHz, 28 GHz, 36 GHz, 39 GHz, 60 GHz, etc.) are easily absorbed and lost in the course of the transmission of the RF signals, the quality of communications may be dramatically reduced. Therefore, antennas for communications in high frequency bands may require approaches different from those of conventional antenna technology, and a separate approach may require further special technologies, such as separate power amplifiers for providing antenna gain, integrating an antenna and RFIC, and providing effective isotropic radiated power (EIRP), and the like.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes: a ground layer; a feed line disposed in a position lower than a position of the ground layer; and an antenna structure including a first radiation part connected to one end of the feed line and configured to provide a first electromagnetic plane in a first direction, and a second radiation part connected to the first radiation part, configured to provide a second electromagnetic plane in a second direction, and disposed such that at least a portion of the second radiation part is disposed in a position higher than the position of the ground layer.

The first electromagnetic plane may include stacked patterns stacked on each other and vias electrically connecting the stacked patterns to each other.

The antenna apparatus may further include a shield structure disposed in a position higher than the position of the ground layer and laterally surrounding at least a portion of the second radiation part.

The shield structure may include ground vias having first ends electrically connected to the ground layer, respectively, and a ground pattern electrically connected to second ends of the ground vias.

The shield structure may have a U-shape in which a portion of the antenna structure is internally disposed.

The antenna apparatus may further include a second ground layer disposed in a position lower than the position of the feed line, wherein the antenna structure further includes a third radiation part connected to the first radiation part, configured to provide a third electromagnetic plane in a third direction, and disposed such that at least a portion of the third radiation part is disposed in a position lower than the position of the second ground layer.

The antenna apparatus may further include a second shield structure disposed in a position lower than the position of the second ground layer and laterally surrounding at least a portion of the third radiation part.

The antenna apparatus may further include a sub-substrate providing a space configured to accommodate the third radiation part and a space configured to accommodate a portion of the first radiation part, wherein an area of an upper surface of the sub-substrate is less than an area of the ground layer.

The antenna apparatus may further include: a second feed line disposed in a position lower than the position of the ground layer; and a second antenna structure including a third radiation part connected to one end of the second feed line and configured to provide a third electromagnetic plane in the first direction, and a fourth radiation part connected to the third radiation part, configured to provide a fourth electromagnetic plane in the second direction, and disposed such that at least a portion of the fourth radiation part is located in a position higher than the position of the ground layer, wherein the first radiation part and the third radiation part have structures extending in directions away from each other.

The antenna apparatus according to claim 9, may further include a shield structure disposed in a position higher than the position of the ground layer and laterally surrounding at least a portion of the second radiation part and at least a portion of the fourth radiation part, together.

A shortest distance between the shield structure and the second radiation part may be shorter than ¼ of a wavelength of an RF signal transmitted and received by the antenna structure.

A shortest distance between the second radiation part and the fourth radiation part may be shorter than a shortest distance between the shield structure and the second radiation part.

The second radiation part and the fourth radiation part may each have a rectangular shape having a long side and a short side, and the long side of the second radiation part and the long side of the fourth radiation part may form a virtual single straight line.

The antenna structure may further include a fifth radiation part connected to the first radiation part, configured to provide a fifth electromagnetic plane in a third direction, and arranged such that at least a portion of the third radiation part is disposed in a position lower than the position of the feed line, and the second antenna structure may further include a sixth radiation part connected to the third radiation part, configured to provide a sixth electromagnetic plane in the third direction, and disposed such that at least a portion of the sixth radiation part is located in a position lower than the position of the second feed line.

The antenna apparatus may further include: a third feed line disposed in a position lower than the position of the ground layer; a third antenna structure including a fifth radiation part connected to one end of the third feed line and configured to provide a fifth electromagnetic plane in the first direction, and a sixth radiation part connected to the fifth radiation part, configured to provide a sixth electromagnetic plane in the second direction, and disposed such that at least a portion of the sixth radiation part is located in a position higher than the position of the ground layer; and a shield structure disposed in a position higher than the position of the ground layer, configured to laterally block at least a portion of the second radiation part and at least a portion of the sixth radiation part of the third antenna structure, and configured to laterally surround at least a portion of the second radiation part and at least a portion of the sixth radiation part, respectively.

In another general aspect, an antenna apparatus includes: a feed line; and an antenna structure including a first radiation part connected to one end of the feed line and configured to provide an electromagnetic plane in a first direction, a second radiation part connected to the first radiation part and configured to provide a second electromagnetic plane in a second direction, and a third radiation part connected to the first radiation part and configured to provide a third electromagnetic plane in a third direction.

The antenna apparatus may further include: a second feed line; and a second antenna structure including a fourth radiation part connected to one end of the second feed line and configured to provide a fourth electromagnetic plane in the first direction, a fifth radiation part connected to the fourth radiation part and configured to provide a fifth electromagnetic plane in the second direction, and a sixth radiation part connected to the fifth radiation part and configured to provide a sixth electromagnetic plane in the third direction, wherein the first radiation part and the fourth radiation part have structures extending in directions away from each other.

In another general aspect, an antenna apparatus includes: a first feed line; a first antenna structure including a first radiation part connected to an end of the first feed line and configured to provide a first electromagnetic plane, and a second radiation part connected to the first radiation part, configured to provide a second electromagnetic plane perpendicular to the first electromagnetic plane; and a ground layer disposed in a position between a position of the first feed line and a position of the second radiation part in a first direction.

The antenna apparatus may further include a third radiation part connected to the first radiation part and configured to provide a third electromagnetic plane perpendicular to the first electromagnetic plane. The position of the first feed line may be between a position of the third radiation part and the position of the second radiation part in the first direction.

The antenna apparatus may further include a shield structure at least partially surrounding the antenna apparatus in one or more planes perpendicular to the second plane.

The antenna apparatus may further include: a second feed line; and a second antenna structure spaced from the first antenna structure in a direction perpendicular to the first direction, and including a second antenna structure including a third radiation part connected to an end of the second feed line and configured to provide a third electromagnetic plane parallel to the first magnetic plane, and a fourth radiation part connected to the third radiation part configured to provide a fourth electromagnetic plane perpendicular to the third electromagnetic plane, wherein the position of the ground layer is between a position of the second feed line and a position of the fourth radiation part in the first direction.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
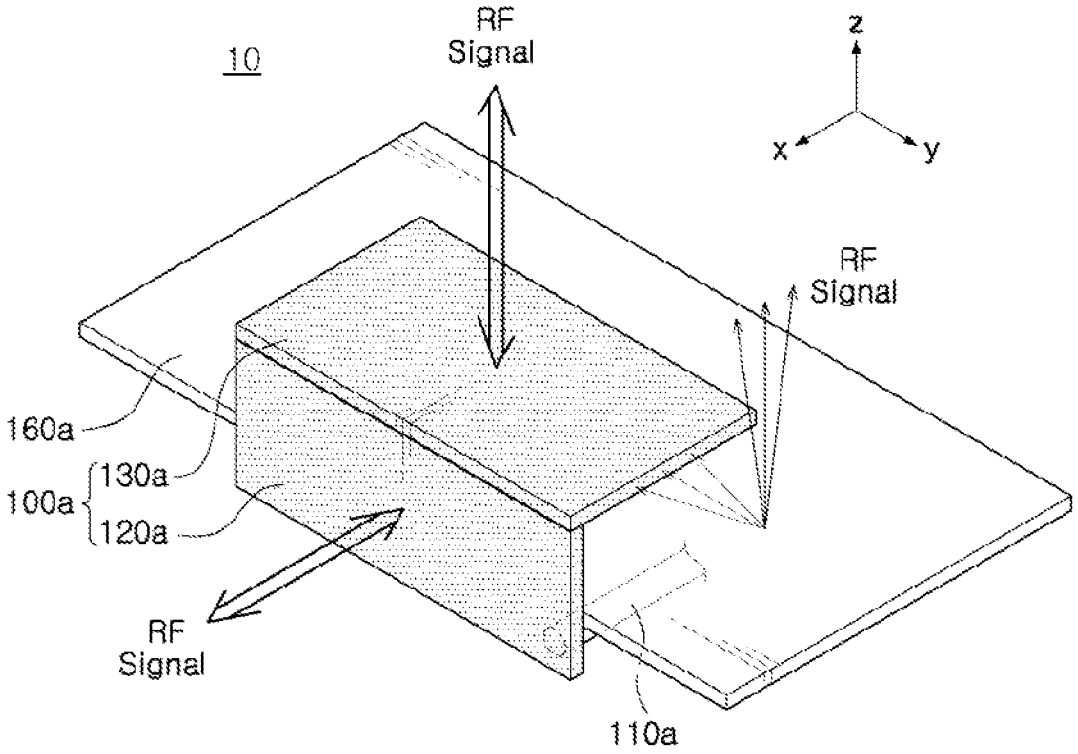
FIG. 1 is a perspective view illustrating an antenna apparatus, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

The features of the examples described herein may be combined in various ways as will be apparent after an understanding of the disclosure of this application. Further, although the examples described herein have a variety of configurations, other configurations are possible as will be apparent after an understanding of the disclosure of this application.

References to "+" in conjunction with the directions x, y, and z in the following description refer to the directions of the x, y, and z arrows, respectively, shown in the drawing figures. References to "−" in conjunction with the directions x, y, and z in the following description refer to directions opposite the directions of the x, y, and z arrows, respectively, shown in the drawing figures.

FIG. 1 is a perspective view illustrating an antenna apparatus 10, according to an embodiment.

Referring to FIG. 1, the antenna apparatus 10 may include a ground layer 160*a*, a feed line 110*a*, and an antenna structure 100*a*.

The feed line 110*a* may be disposed in a position lower than a position of the ground layer 160*a*. The feed line 110*a* may transmit a radio frequency (RF) signal received from the antenna structure 100*a* to the IC, and may transmit an RF signal received from the IC to the antenna structure 100*a*.

The antenna structure 100*a* may include a first radiation part 120*a* connected to one end of the feed line 110*a* and providing an electromagnetic plane in a first direction (e.g., a +x direction). An RF signal to be received from the feed line 110*a* or to be transmitted to the feed line 110*a* may pass through the electromagnetic plane of the first radiation part 120*a*. Therefore, the antenna structure 100*a* may transmit and receive an RF signal in the first direction through the electromagnetic plane of the first radiation part 120*a*.

In addition, the antenna structure 100*a* may further include a second radiation part 130*a* connected to the first radiation part 120*a* to provide an electromagnetic plane in a second direction (e.g., a +z direction), and disposed such that at least a portion of second radiation part 130*a* is located in a position higher than a position of the ground layer 160*a*. A portion of an RF signal to be received from the feed line 110*a* or to be transmitted to the feed line 110*a* may be transmitted and received in the first radiation part 120*a*, and another portion of the RF signal may be passed through the electromagnetic plane of the second radiation part 130*a*.

Therefore, since the antenna structure 100*a* may transmit and receive an RF signal through the electromagnetic plane of the first radiation part 120*a* in the first direction and may also transmit and receive an RF signal through the electromagnetic plane of the second radiation part 130*a* in the second direction, the transmission/reception direction of the RF signal may be expanded.

In this example, a feed path of the first radiation part 120*a* and a feed path of the second radiation part 130*a* in the antenna structure 100*a* are both formed by the feed line 110*a*. For example, the antenna apparatus 10 may transmit and receive an RF signal in both the first direction and the second direction by using the integrated feed path. Therefore, the antenna apparatus 10 may reduce the number, length, and complexity of the feed line 110*a* in comparison to conventional antenna apparatuses, and thus may reduce the size or improve the antenna performance (for example, reduce an RF signal loss in the feed line) in comparison to conventional antenna apparatuses.

Also, the first radiation part 120*a* and the second radiation part 130*a* of the antenna structure 100*a* may be arranged close to each other. In general, a first directional antenna and a second directional antenna may each be spaced apart by a distance greater than a predetermined or specified distance, or may require a component for electromagnetic shielding, to reduce an electromagnetic effect on each other. A distance between the first radiation part 120*a* and the second radiation part 130*a* may be shorter than a predetermined or specified distance. A separate component for electromagnetic shielding between the first radiation part 120*a* and the second radiation part 130*a* may not be required. Therefore, the antenna apparatus 10 may be further minimized, and may have improved antenna performance relative to size, in comparison to conventional antenna apparatuses.

The ground layer 160*a* may act as a reflector for the first and second radiation parts 120*a* and 130*a* of the antenna structure 100*a*, respectively. For example, a portion of an RF signal passed through the first radiation part 120*a* of the antenna structure 100*a* in the −x direction may be reflected in the ground layer 160*a* in a +x direction. A portion of an RF signal passed through in the second radiation part 130*a* in a −z direction may be reflected in the ground layer 160*a* in a +z direction.

Therefore, the antenna apparatus 10 may have further improved gain, and may reduce electromagnetic noise applied to the feed line 110*a* by the antenna structure 100*a*, in comparison to conventional antenna apparatuses.

Also, the ground layer 160*a* may be electromagnetically coupled to the second radiation part 130*a* of the antenna structure 100*a*. Therefore, the antenna structure 100*a* may effectively draw a portion of an RF signal from the first radiation part 120*a* to the second radiation part 130*a*, such that the RF signal transmitted and received in the first radiation part 120*a* and the RF signal transmitted and received in the second radiation part 130*a* may be balanced.

Figure 2:
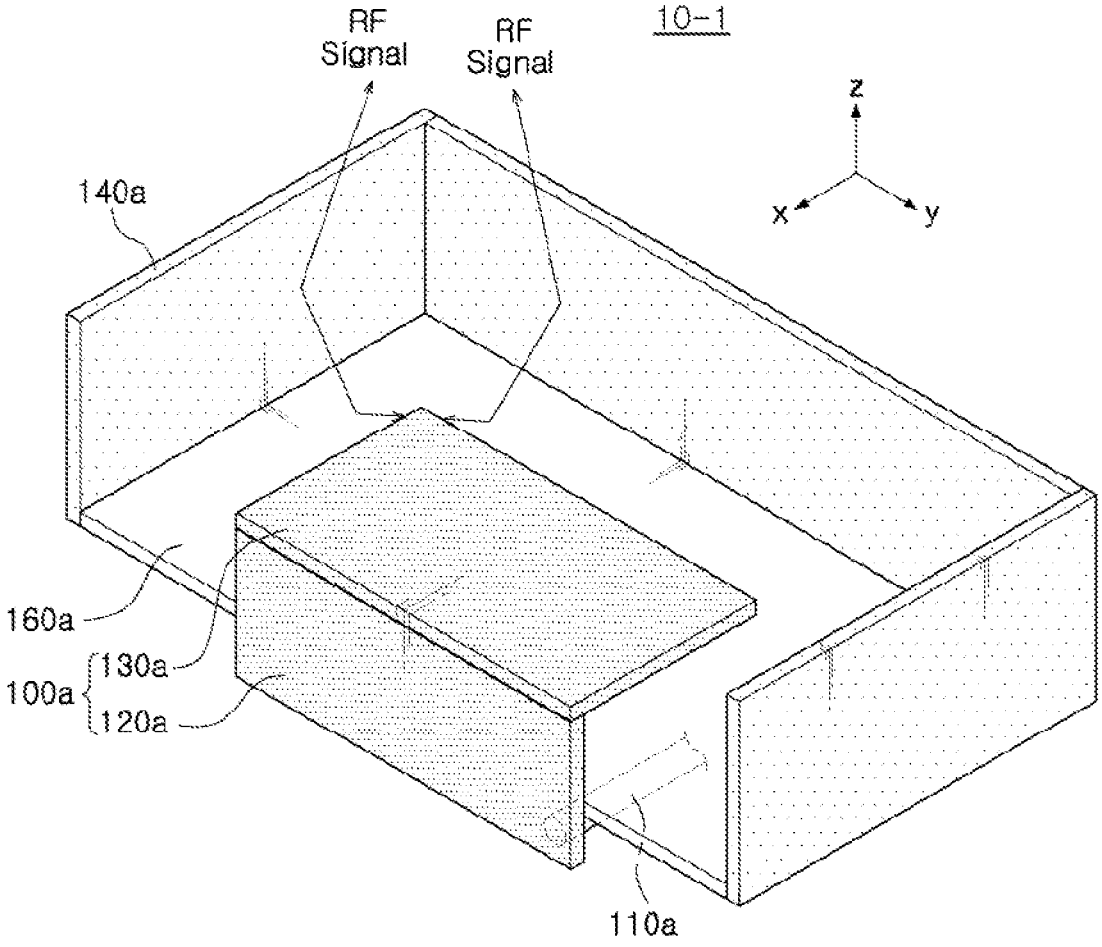
FIG. 2 is a perspective view illustrating an antenna apparatus including a shield structure, according to an embodiment.

FIG. 2 is a perspective view illustrating an antenna apparatus 10-1 including a shield structure 140*a*, according to an embodiment. For example, the antenna apparatus 10-1 may be similar to the antenna apparatus 10 illustrated in FIG. 1, except that the antenna apparatus 10-1 includes the shield structure 140*a*.

Referring to FIG. 2, the antenna apparatus 10-1 may include, in addition to the components described in the antenna apparatus 10 illustrated in FIG. 1, the shield structure 140*a* disposed in a position higher than a position of a ground layer 160*a* to surround at least a portion of the second radiation part 130*a* of the antenna structure 100*a* in lateral directions (e.g., one or more of the x and y directions).

The shield structure 140*a* may reflect electromagnetic noise caused by an adjacent antenna apparatus, and may reflect an RF signal transmitted from the antenna structure 100*a* to the ground layer 160*a* in the z direction.

Therefore, the antenna apparatus 10-1 may improve the electromagnetic isolation degree for an adjacent antenna apparatus, and may have improved gain in comparison to conventional antenna apparatuses.

The antenna structure 100*a* may have an L shape according to a vertical connection between the first radiation part 120*a* and the second radiation part 130*a*, but is not limited to such a configuration. For example, an electromagnetic plane of the first radiation part 120*a* may be slightly inclined, such that a normal line is directed in the −z direction.

Figure 3:
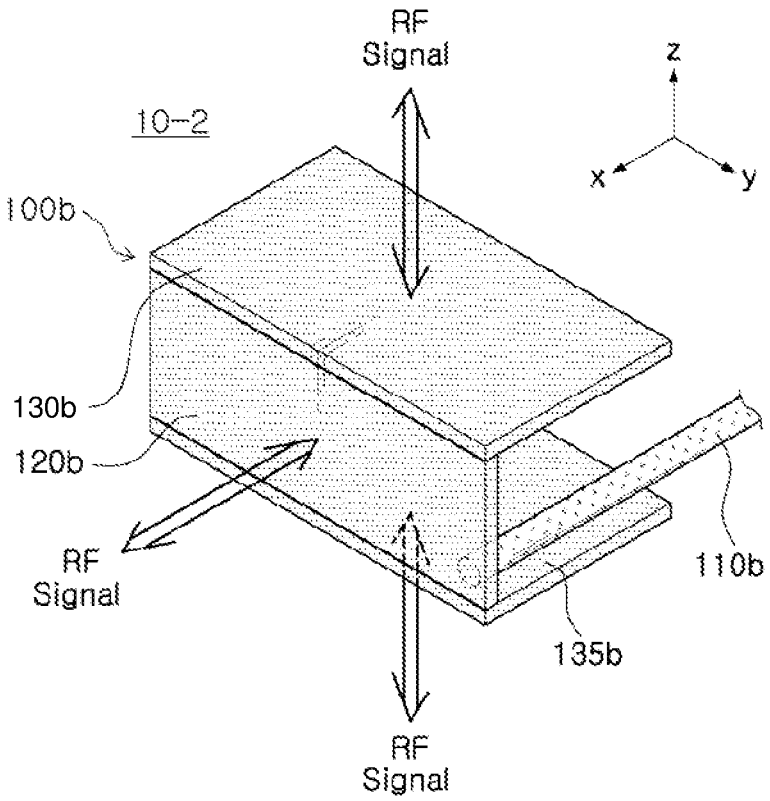
FIG. 3 is a perspective view illustrating an antenna apparatus, according to an embodiment.

FIG. 3 is a perspective view illustrating an antenna apparatus 10-2, according to an embodiment.

Referring to FIG. 3, in the antenna apparatus 10-2, an antenna structure 100*b* may further include a third radiation part 135*b* connected to a first radiation part 120*b* to provide an electromagnetic plane in a third direction (e.g., the z direction), and disposed such that at least a portion of the third radiation part 135*b* is positioned in a position lower than a position of a feed line 110*b*.

A portion of an RF signal to be received from the feed line 110*b* or to be transmitted to the feed line 110*b* may be transmitted and/or received by the first radiation part 120*b*, and the other may be transmitted and/or received through an electromagnetic plane of a second radiation part 130*b*.

Therefore, since the antenna structure 100*b* transmits and receives an RF signal through an electromagnetic plane of the first radiation part 120*b* in a first direction, an RF signal through an electromagnetic plane of the second radiation part 130*b* in a second direction, and an RF signal through an electromagnetic plane of the third radiation part 135*b* in a third direction, the transmission/reception direction of the RF signal may be further expanded.

The antenna structure 100*b* may have a frequency band (e.g., 28 GHz, 60 GHz) determined in accordance with a magnitude relationship, an angular relationship, a thickness relationship, and a positional relationship of the first, second and third radiation parts 120*b*, 130*b*, and 135*b* with respect to the surrounding components (e.g., a ground layer, and a shield structure).

Figure 4:
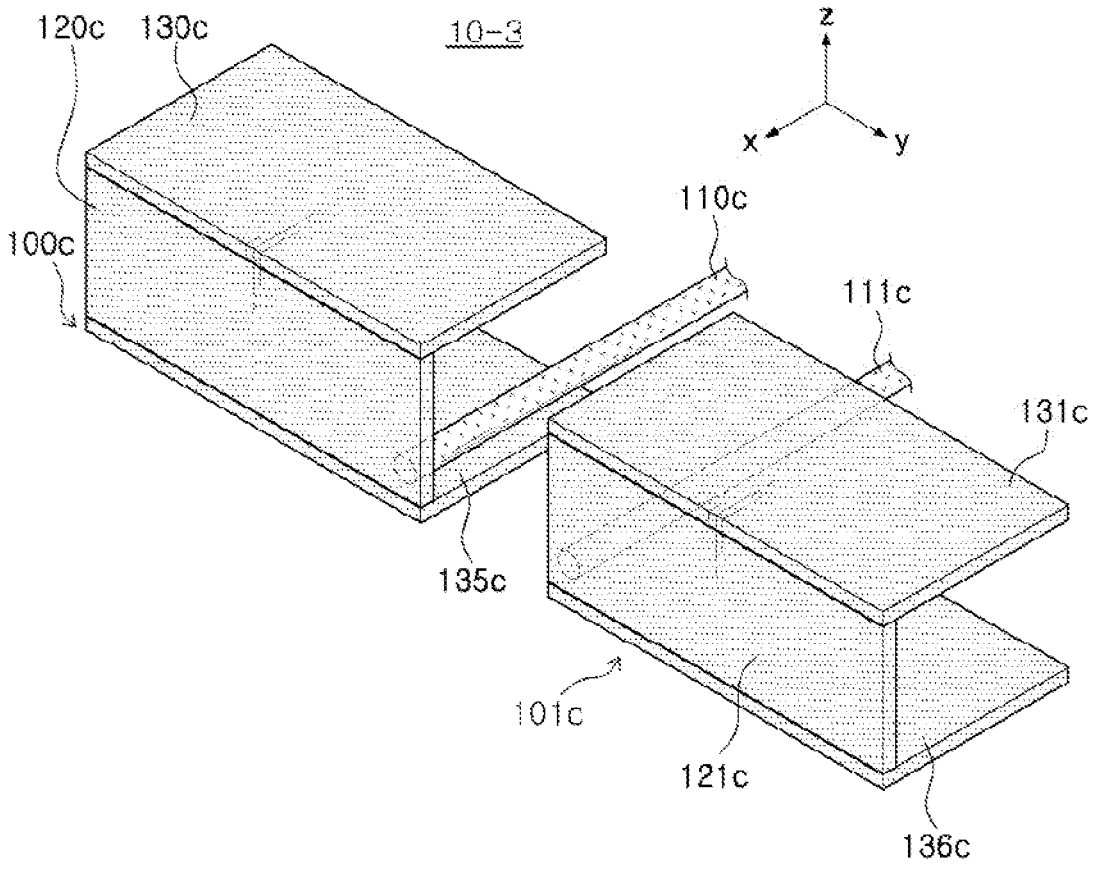
FIG. 4 is a perspective view illustrating an antenna apparatus including a first antenna structure and a second antenna structure, according to an embodiment.

FIG. 4 is a perspective view illustrating an antenna apparatus 10-3 including a first antenna structure 100*c* and a second antenna structure 101*c*, according to an embodiment.

Referring to FIG. 4, the antenna apparatus 10-3 may include a first feed line 110*c*, the first antenna structure 100*c*, a second feed line 111*c*, and the second antenna structure 101*c*. The first antenna structure 100*c* may include a first radiation part 120*c*, a second radiation part 130*c*, and a third radiation part 135*c*. The second antenna structure 101*c* may include at least a portion of a fourth radiation part 121*c*, a fifth radiation part 131*c*, and a sixth radiation part 136*c*.

The first feed line 110*c* may transfer an RF signal received from the first antenna structure 100*c* to the IC, and may transfer an RF signal received from the IC to the first antenna structure 100*c*.

The second feed line 111*c* may transfer an RF signal received from the second antenna structure 101*c* to the IC, and may transfer an RF signal received from the IC to the second antenna structure 101*c*. For example, the second feed line 111*c* may be disposed in parallel with the first feed line 110*c*, and may be disposed on the same level as the first feed line 110*c*, relative to the z axis.

The fourth radiation part 121*c* may be connected to one end of the second feed line 111*c*, may provide an electromagnetic plane in a first direction (e.g., the +x direction), and may transmit and receive an RF signal in the first direction, based on a principle similar to that of the first radiation part 120*c* of the first antenna structure 100*c*.

The fifth radiation part 131*c* may be connected to the fourth radiation part 121*c* to provide an electromagnetic plane in a second direction (e.g., the +z direction), may be disposed in a position higher than a position of the second feed line 111*c*, and may transmit and receive RF signals in the second direction, based on a principle similar to the second radiation part 130*c* of the first antenna structure 100*c*.

The sixth radiation part 136*c* may be connected to the fourth radiation part 121*c* to provide an electromagnetic plane in a third direction (e.g., the −z direction), and disposed such that at least a portion of the sixth radiation part 136*c* is positioned in a position lower than a position of the second feed line 111*c*.

The first radiation part 120*c* of the first antenna structure 100*c* and the fourth radiation part 121*c* of the second antenna structure 101*c* may have an expanded structure in a direction in which one end of the feed line 110*c* is spaced away from one end of the second feed line 111*c* (e.g., the y direction).

Therefore, the first radiation part 120*c* of the antenna structure 100*c* and the fourth radiation part 121*c* of the second antenna structure 101*c* may transmit and receive an RF signal in a first direction, based on a similar principle to that of a dipole of a dipole antenna. In general, since a dipole antenna may have a wider bandwidth than a monopole antenna, the antenna apparatus 10-3 may have a relatively wide bandwidth by using the first radiation part 120*c* and the fourth radiation part 121*c*, in a similar manner to that of a dipole antenna.

Figure 5A:
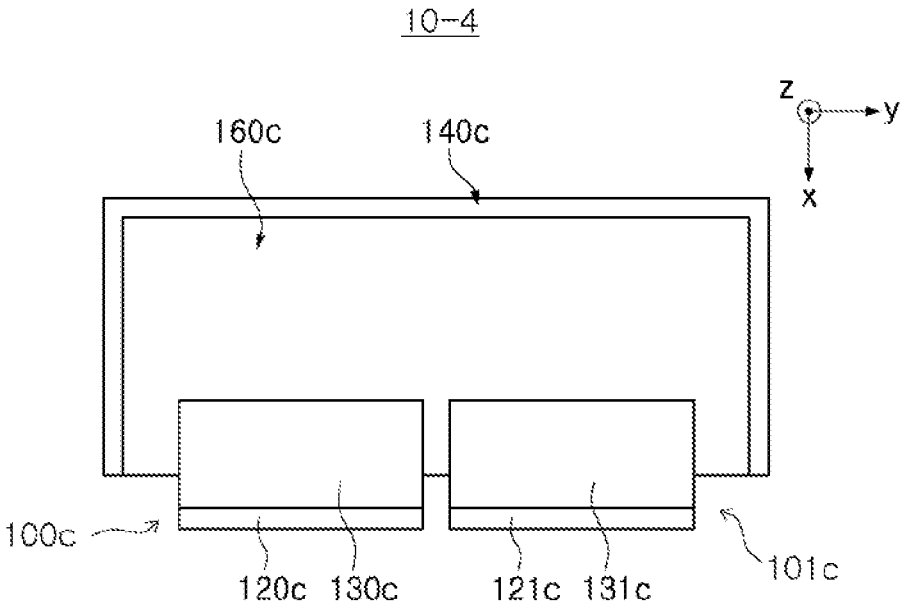
FIG. 5A is a plan view illustrating an antenna apparatus including a shield structure, according to an embodiment.
Figure 5B:
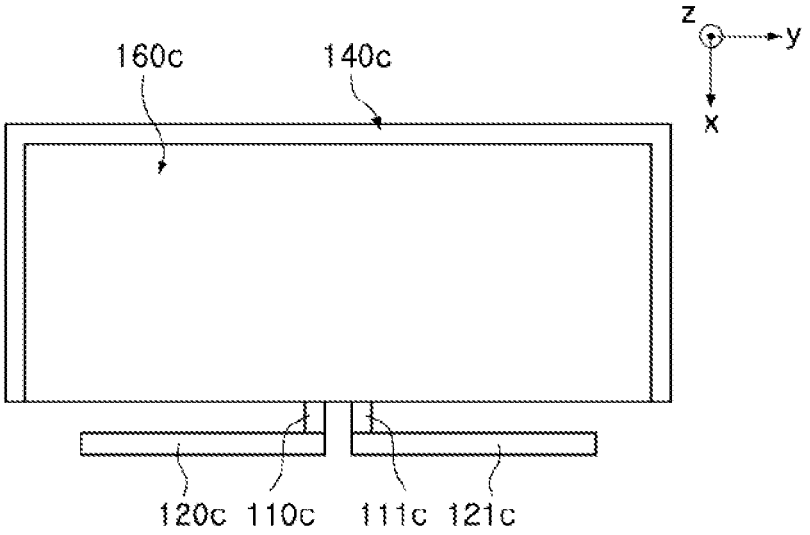
FIG. 5B is a plan view illustrating the antenna apparatus of FIG. 5A with some radiation parts omitted.

FIG. 5A is a plan view illustrating an antenna apparatus 10-4 that is similar to the antenna apparatus 10-3 illustrated in FIG. 4, but additionally includes a shield structure 140*c*. FIG. 5B is a plan view illustrating the antenna apparatus 10-4 illustrated in FIG. 5A with a second radiation part 130*c* and fifth radiation part 131*c* omitted.

Referring to FIGS. 5A and 5B, a shield structure 140*c* may be disposed in a position higher than a position of a ground layer 160*c* to surround at least a portion of a second radiation part 130*c* of the first antenna structure 100*c* and at least a portion of a fifth radiation part 131*c* of the second antenna structure 101*c*, together. Therefore, an antenna apparatus 10-4 may improve an electromagnetic isolation of an adjacent antenna apparatus while having a relatively wide bandwidth, and may have improved gain due to reflection of an RF signal in the shield structure 140*c*.

For example, the shield structure 140*c* has a U-shape in the xy plane, and may be disposed such that a portion of a second radiation part 130*c* and a portion of the fourth radiation part 131*c* are disposed within the U-shape.

In addition, a shortest distance (e.g., a spacing distance in the y direction) between the shield structure 140*c* and the second radiation part 130*c* may be shorter than ¼ of a wavelength of an RF signal transmitted and received by the antenna structure 100*c*. Therefore, the antenna structure 100*c* may be efficiently connected to the shield structure 140*c*, and may have a finely tuned resonance frequency through a capacitance between the shield structure 140*c* and the antenna structure 100*c*

A shortest distance (e.g., a spacing distance in a y direction) between the second radiation part 130*c* and the fifth radiation part 131*c* may be shorter than a shortest distance (e.g., a spacing distance in the y direction) between the shield structure 140*c* and the second radiation part 130*c*. Therefore, the antenna apparatus 10-4 may further suppress dispersion in a y direction during transmission and reception of RF signals.

The second radiation part 130*c* and the fifth radiation part 131*c* may have a rectangular shape having a long side (for example, a y direction side) and a short side (for example, an x direction side). An RF signal may include an x vector component and a y vector component. The y vector component may be more likely to be offset than the x vector component. When the second radiation part 130*c* and the fifth radiation part 131*c* have a rectangular shape, a ratio of the x vector component in the RF signal may be relatively higher. Therefore, an antenna apparatus 10-4 may have further improved gain with respect to a conventional antenna apparatus.

In addition, the long side of the second radiation part 130*c* and the long side of the fifth radiation part 131*c* may form a virtual single straight line. Therefore, an antenna apparatus 10-4 may further suppress dispersion in the y direction during transmission and reception of RF signals.

Figure 6:
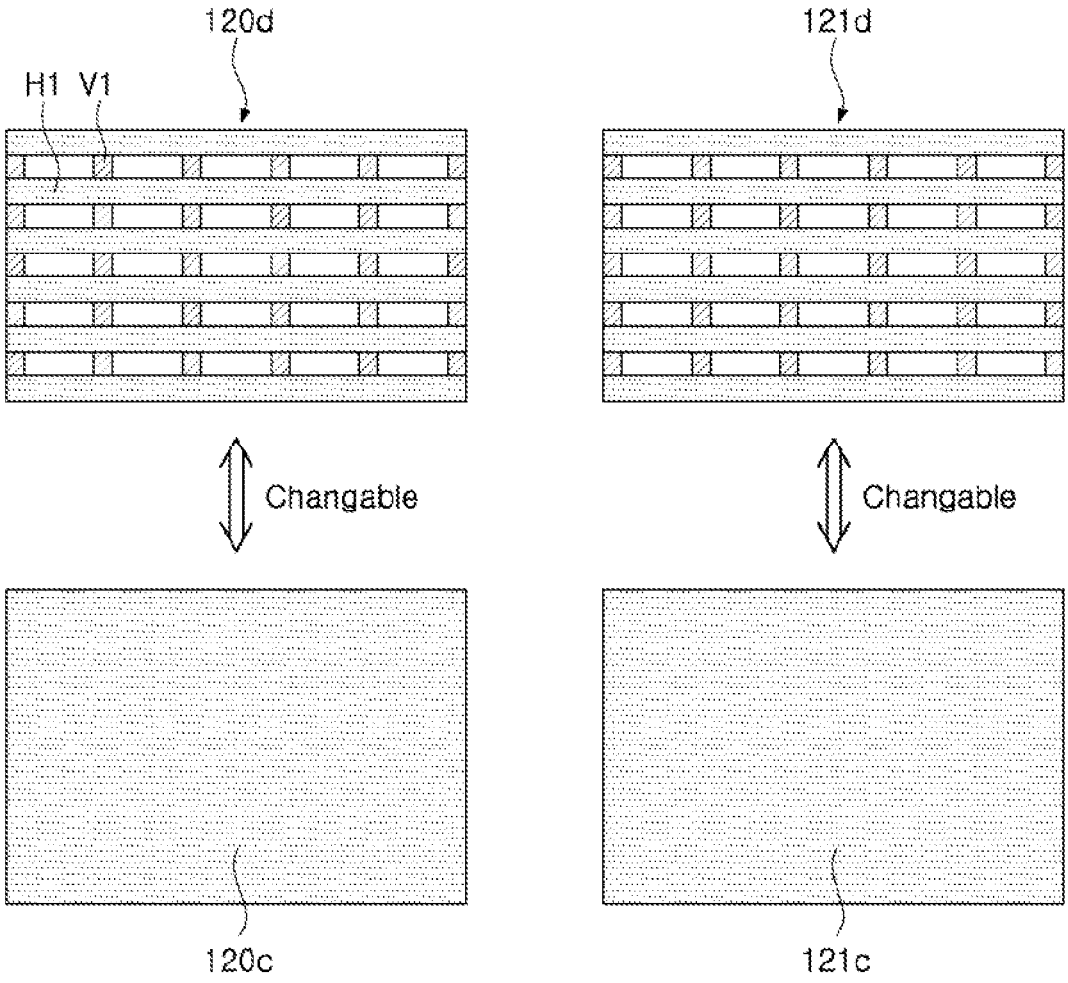
FIG. 6 is a plan view illustrating an electromagnetic plane of an antenna structure of an antenna apparatus, according to an embodiment.

FIG. 6 is a plan view illustrating an electromagnetic plane of an antenna structure of an antenna apparatus, according to an embodiment.

Referring to FIG. 6, each of a first radiation part 120*d* and a fourth radiation part 121*d* of the antenna structure may be formed of stacked patterns H1, and vias V1 electrically connected between adjacent stacked patterns among the stacked patterns H1. That is, each of the vias V1 may be electrically connected to adjacent stacked patterns among the stacked patterns H1.

An RF signal may have a relatively short wavelength. Therefore, the RF signal may pass through the first radiation part 120*d* and the fourth radiation part 121*d*, as no space is provided between the stacked patterns H1 and between the vias V1 are provided.

Therefore, each of the first radiation part 120*c* and the fourth radiation part 121*c* illustrated in FIGS. 4 to 5B may be replaced by the first radiation part 120*d* and the fourth radiation part 121*d*, which are composed of the stacked patterns H1 and the vias V1.

Figure 7A:
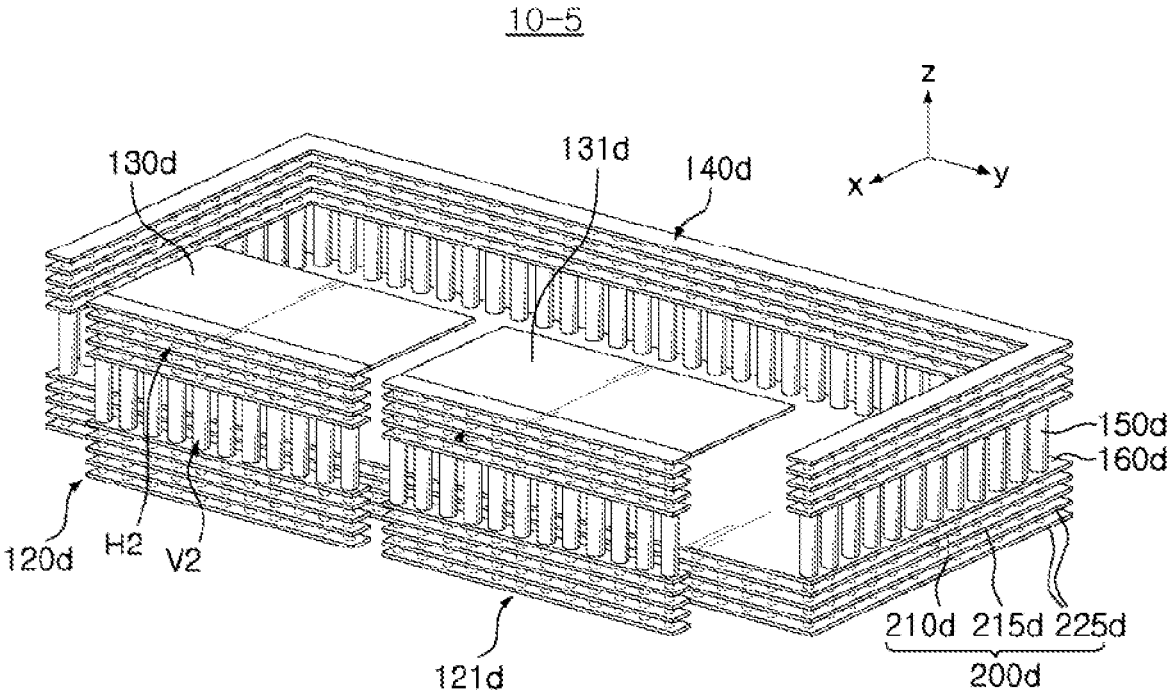
FIGS. 7A and 7B are views illustrating an antenna apparatus, according to an embodiment.
Figure 7B:
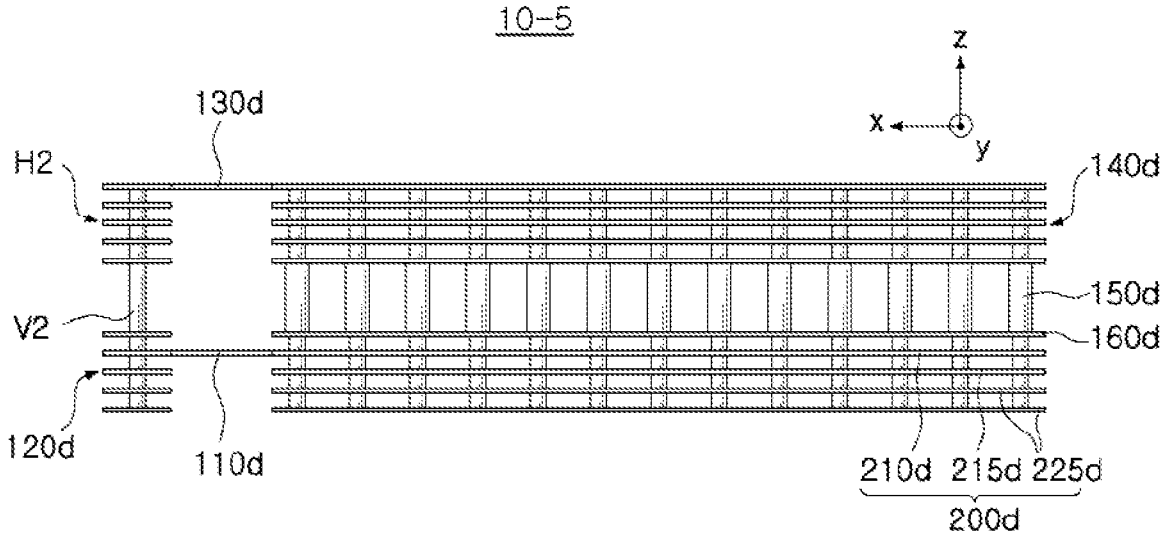

FIGS. 7A and 7B are views illustrating a first specific structure of an antenna apparatus 10-5, according to an embodiment.

Referring to FIGS. 7A and 7B, an antenna apparatus 10-5 may include at least a portion of a feed line 110*d*, a first radiation part 120*d*, a fourth radiation part 121*d*, a second radiation part 130*d*, a fifth radiation part 131*d*, a shield structure 140*d*, a ground layer 160*d*, and a connection member 200*d*.

The first radiation part 120*d* and the second radiation part 121*d* may have a structure in which a stacked patterns H2 and vias V2 are coupled together.

The connection member 200*d* may include at least a portion of a wiring layer 210*d*, a second ground layer 215*d*, and an IC ground layer 225*d*. An IC may be disposed in a position lower than a position of the connection member 200*d*. Boundaries of the wiring layer 210*d*, the second ground layer 215*d*, and the IC ground layer 225*d* in the connection member 200*d* may act as a reflector for the first radiation part 120*d* and the fourth radiation part 121*d*, and thus may affect the antenna performance of the first radiation part 120*d* and the fourth radiation part 121*d*.

The feed line 110*d* may be disposed on the same height (in the z direction) as the wiring layer 210*d*. The ground layer 160*d* may be disposed in a position higher than a position of the wiring layer 210*d*, and the second ground layer 215*d* may be disposed in a position lower than a position of the wiring layer 210*d*. The ground layer 160*d* and the second ground layer 215*d* may provide an electromagnetic shielded environment for the feed line 110*d*.

The IC ground layer 225*d* may provide a ground used for operation of the IC, and may be disposed in a position lower than a position of the second ground layer 215*d*. The positional relationship, number and size of the wiring layer 210*d*, the second ground layer 215*d*, and the IC ground layer 225*d* may be freely changed, depending on design specifications.

The antenna apparatus 10-5 may reduce the number, length, and complexity of the feed lines 110*d*, thereby reducing the size of the wiring layer 210*d*. Therefore, a size of the ground layer 160*d* and a size of the second ground layer 215*d* may be reduced as well. Therefore, the antenna apparatus 10-5 may have a reduced size, in comparison to a conventional antenna apparatus, while transmitting and receiving RF signals in multiple directions. Depending on design specifications, the antenna apparatus 10-5 may further include a component (for example, an impedance converter, a shield via, a branch circuit, etc.) configured to improve the antenna performance by utilizing a free space of the wiring layer 210*d*.

The shield structure 140*d* may have a structure in which ground vias 150*d* and ground patterns, electrically connected to the ground layer 160*d*, are coupled together. For example, since the shield structure 140*d* may have a structure similar to the coupled structure of the stacked patterns H2 and the vias V2 of the first radiation part 120*d*, an RF signal may be effectively reflected.

The second radiation part 130*d* may be disposed at the same height as an uppermost ground pattern of the shield structure 140*d*, but is not limited to such a configuration, and may vary according to design specifications such as frequency, bandwidth, and gain of an RF signal.

Figure 8A:
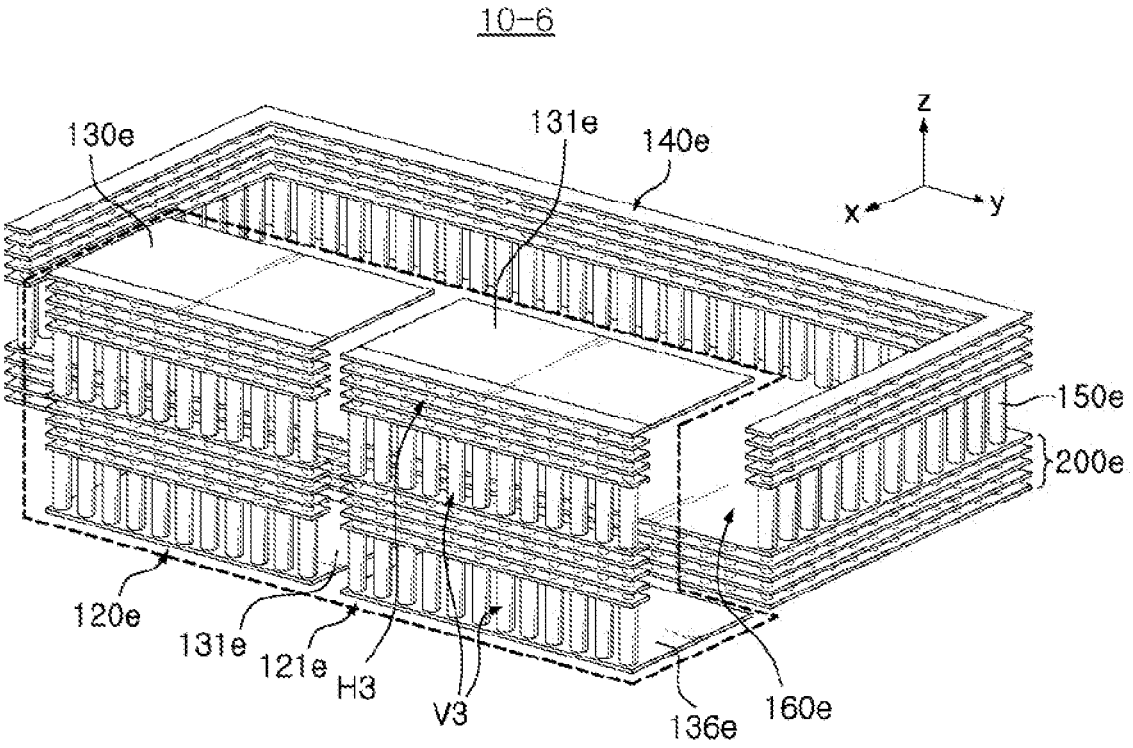
FIGS. 8A and 8B are views illustrating an antenna apparatus, according to an embodiment.
Figure 8B:
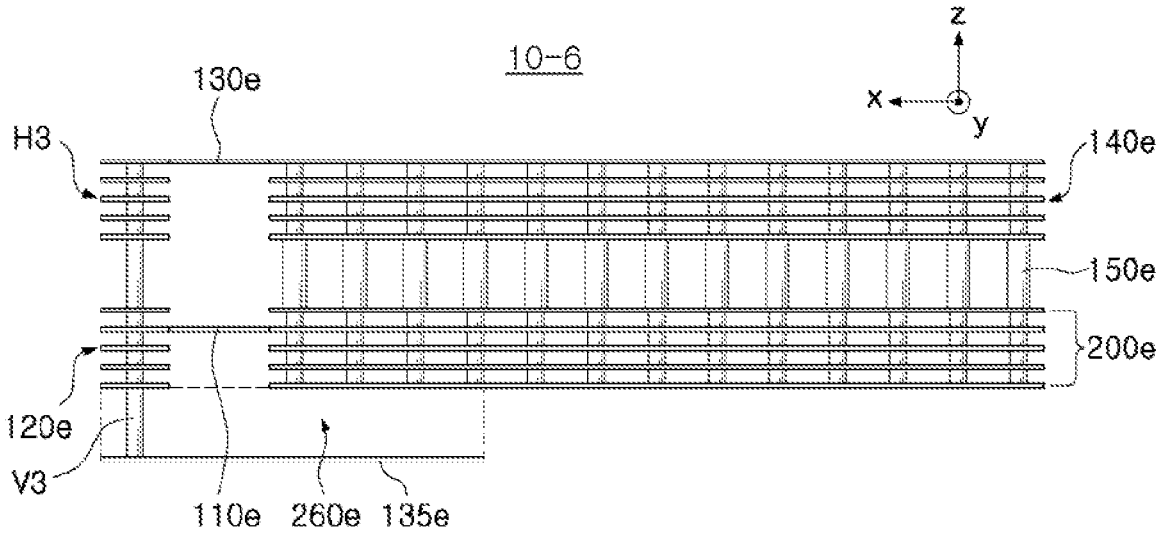

FIGS. 8A and 8B are views illustrating an antenna apparatus 10-6, according to an embodiment.

Referring to FIGS. 8A and 8B, the antenna apparatus 10-6 may include at least a portion of a feed line 110*e*, a first radiation part 120*e*, a fourth radiation part 121*e*, a second radiation part 130*e*, a fifth radiation part 131*e*, a third radiation part 135*e*, a sixth radiation part 136*e*, a shield structure 140*e*, a ground via 150*e*, a ground layer 160*e*, and a connection member 200*e*.

The first radiation part 120*e* and the second radiation part 121*e* may have a structure in which a stacked patterns H3 and vias V3 are coupled together.

A portion of the third radiation part 135*e* and a portion of the sixth radiation part 136*e* may overlap the connection member 200*e* in the xy plane. Therefore, the connection member 200*e* may act as a reflector for the third radiation part 135*e* and the sixth radiation part 136*e*, and may be electromagnetically coupled to the third radiation part 135*e* and the sixth radiation part 136*e*.

In addition, an antenna apparatus 10-6 may further include a sub-substrate 260*e* that provides a space for arranging the third radiation part 131*e*, a space for arranging the sixth radiation part 136*e*, a space for arranging a portion of the first radiation part 120*e*, and a space for arranging a portion of the fourth radiation part 121*e*.

An area of an upper surface of the sub-substrate 260*e* may be smaller than an area of the ground layer of the connection member 200*e*. Therefore, an IC providing an RF signal to the antenna apparatus may be spaced from the sub-substrate 260*e* in a lateral direction (in the xy plane).

Depending on design specifications, a shield via (not illustrated) for electromagnetic shielding between the antenna structure and the IC may be disposed on a side surface of the sub-substrate 260*e*.

Figure 9A:
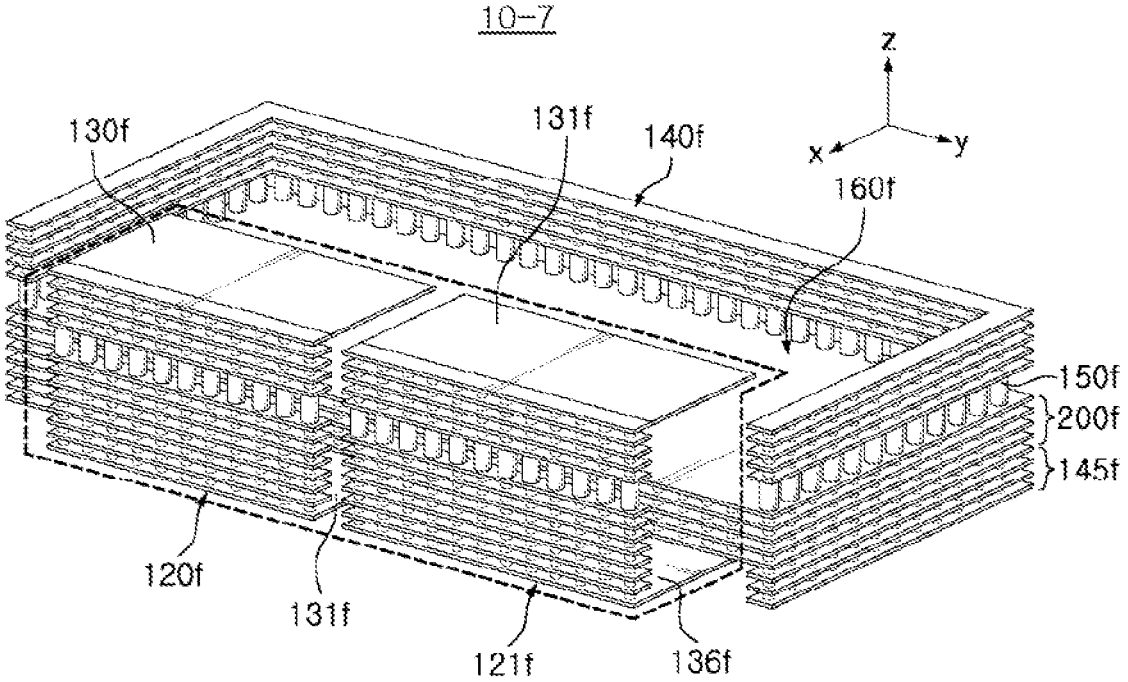
FIGS. 9A and 9B are views illustrating an antenna apparatus, according to an embodiment.
Figure 9B:
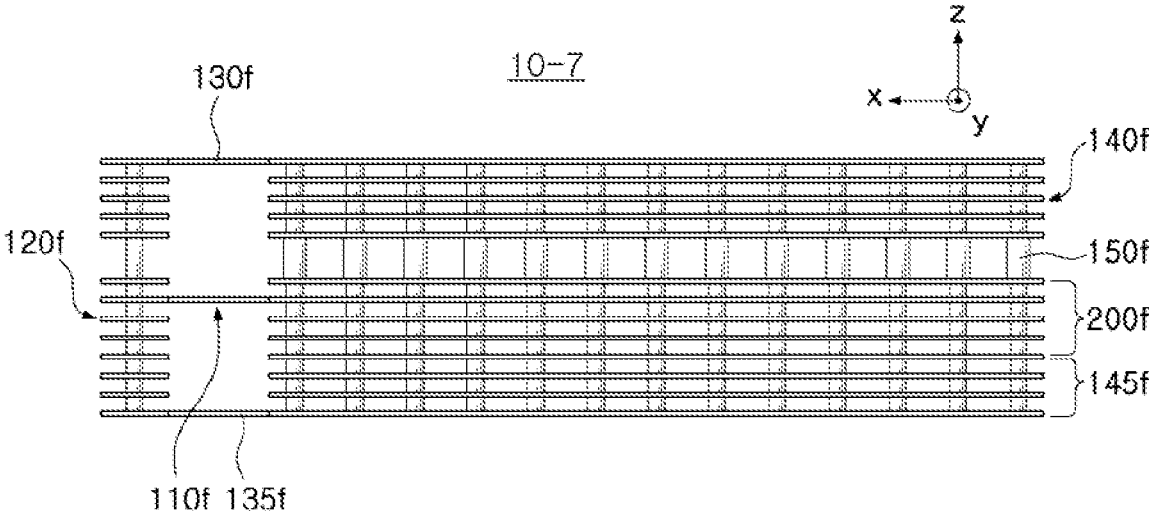

FIGS. 9A and 9B are views illustrating an antenna apparatus 10-7, according to an embodiment.

Referring to FIGS. 9A and 9B, the antenna apparatus 10-7 may include at least a portion of a feed line 110*f*, a first radiation part 120*f*, a fourth radiation part 121*f*, a second radiation part 130*f*, a fifth radiation part 131*f*, a third radiation part 135*f*, a sixth radiation part 136*f*, a first shield structure 140*f*, a second shield structure 145*f*, a first ground via 150*f*, a second ground layer 160*f*, and a connection member 200*f*.

The second shield structure 145*f* may be disposed in a position lower than a position of the connection member 200*f* to surround at least a portion of the third radiation part 135*f* and at least a portion of the sixth radiation part 136*f* in lateral directions (e.g., the x and y directions).

Also, the second shield structure 145*f* may be disposed in a position corresponding to the first shield structure 140*f* in a vertical direction (e.g., the z direction), and may thus be electromagnetically coupled to the third radiation part 135*f* and the sixth radiation part 136*f*.

The third radiation part 135*f* and the sixth radiation part 136*f* may be arranged at the same height as a lowermost ground layer of the connection member 200*f*, but is not limited to such a configuration, and may vary according to design standards such as the frequency, bandwidth, and gain of an RF signal.

Figure 10A:
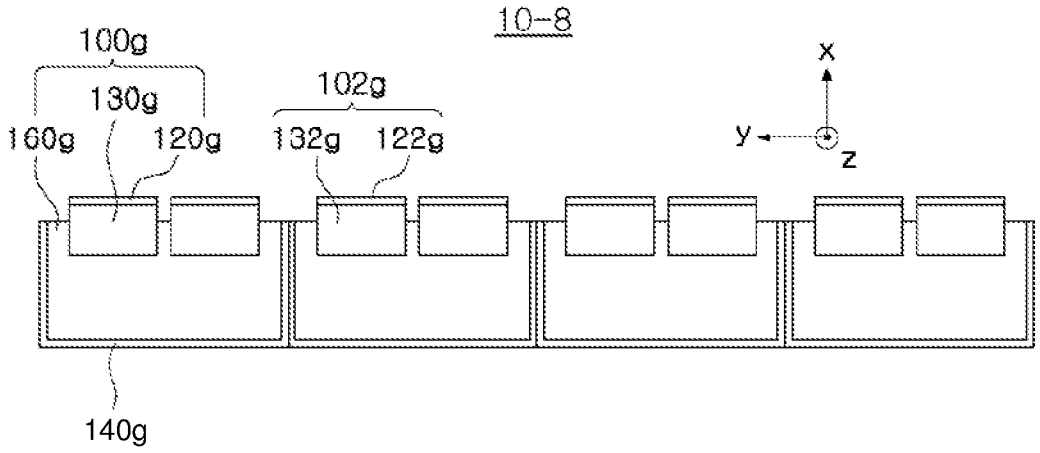
FIGS. 10A and 10B are views illustrating an array structure of an antenna apparatus, according to an embodiment.
Figure 10B:
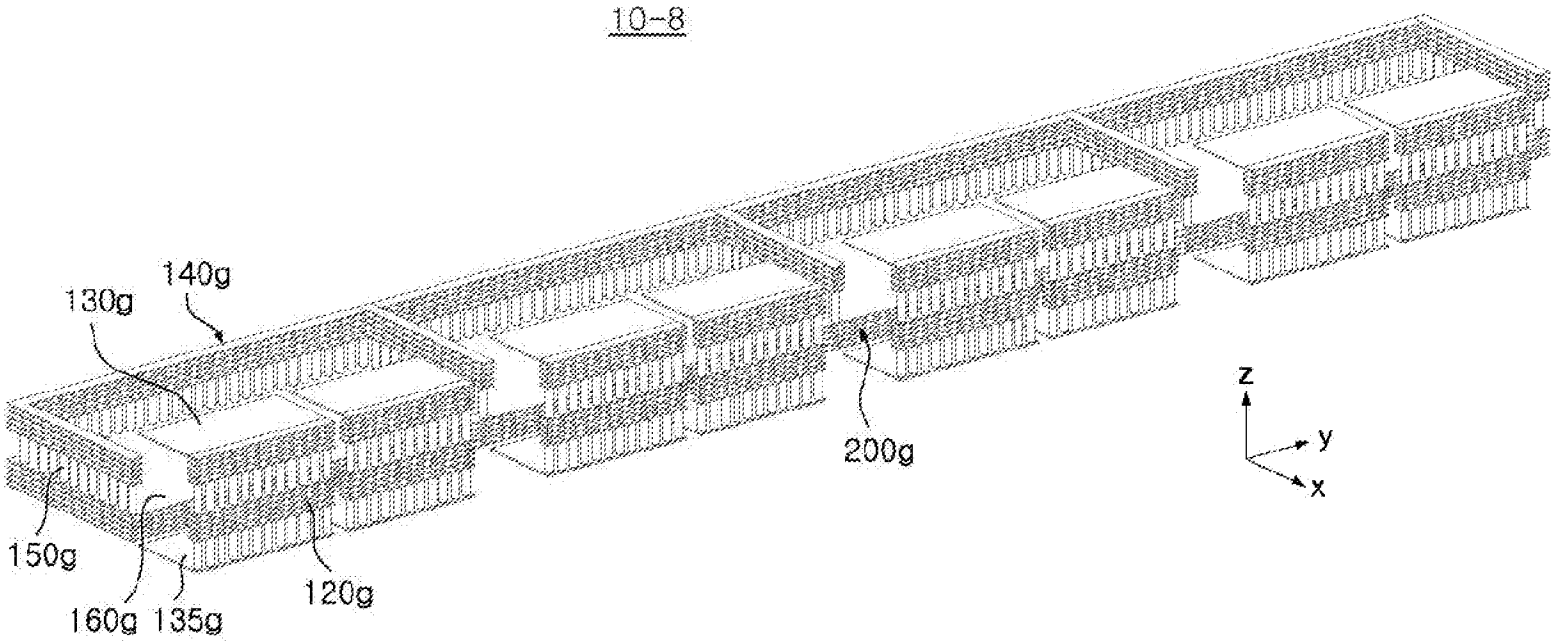

FIGS. 10A and 10B are views illustrating an array structure of an antenna apparatus 10-8, according to an embodiment.

Referring to FIGS. 10A and 10B, the antenna apparatus 10-8 may include antenna structures arranged in a 1×n structure. In this case, n may be a natural number of 2 or more. Each of the second through nth antenna structures may include radiation parts corresponding to a first radiation part 120*g*, a second radiation part 130*g*, and a third radiation part 135*g* of a first antenna structure 100*g*.

For example, one of the antenna structures may be a third antenna structure 102*g*, and may be connected to one end of a third feed line disposed in a position lower than a position of a ground layer 160*g*.

The third antenna structure 102*g* may include a seventh radiation part 122*g* connected to one end of the third feed line and providing an electromagnetic plane in a first direction, and an eighth radiation part 132*g* connected to the seventh radiation part 122*g* to provide an electromagnetic plane in a second direction and disposed such that at least a portion of the eighth radiation part 132*g* is positioned in a position higher than a position of the ground layer 160*g*.

The ground layer 160*g* may have a size corresponding to the number of the antenna structures. The number of feed lines connected to each of the antenna structures may correspond to the number of the antenna structures, and may affect the size of the ground layer 160*g* and the connection member 200*g*. Since the number, length, and complexity of the feed lines may be reduced, the size of the ground layer 160*g* and the connection member 200*g* may be reduced.

The shield structure 140*g* may surround at least a portion of each of the antenna structures, or may surround the antenna structures in units of two, and may include ground patterns and ground vias 150*g*.

For example, the shield structure 140*g* may be disposed in a position higher than a position of the ground layer 160*g* to block at least a portion of the second radiation part 130*g* of the first antenna structure 100*g* and at least a portion of the eighth radiation part 132*g* of the third antenna structure 102*g*, and to surround at least a portion of the second radiation part 130*g* of the first antenna structure 100*g* and at least a portion of the eighth radiation part 132*g* of the third antenna structure 102*g*, respectively, in the x direction and/or they direction.

Figure 11A:
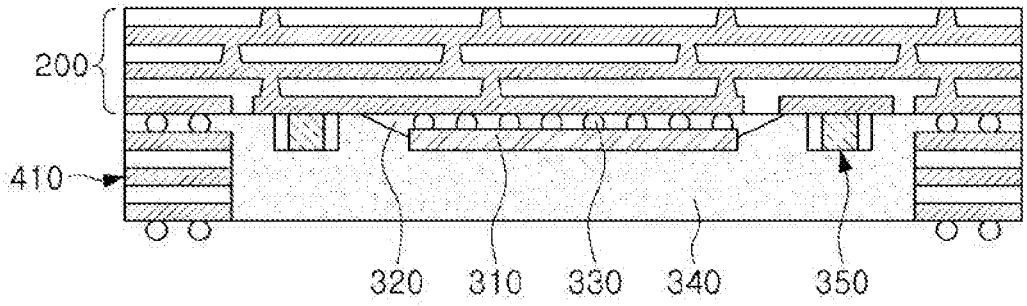
FIGS. 11A and 11B are views illustrating a structure disposed in a position lower than a position of a connection member included in an antenna apparatus, according to an embodiment.
Figure 11B:
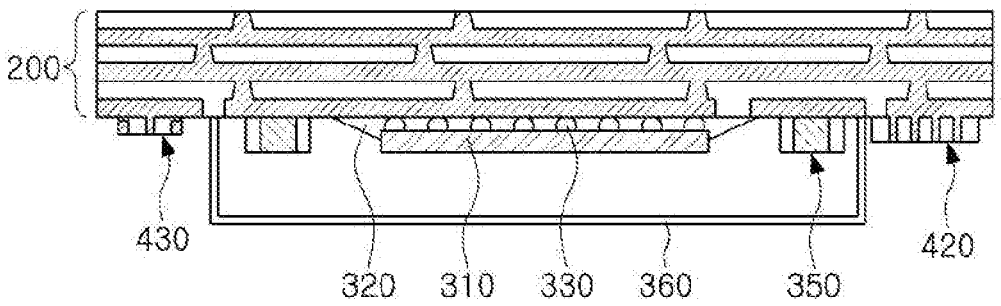

FIGS. 11A and 11B are views illustrating a structure disposed in a position lower than a position of the connection member 200 included in an antenna apparatus, according to an embodiment.

Referring to FIG. 11A, an antenna apparatus, according to an embodiment, may include at least a portion of a connection member 200, an IC 310, an adhesive member 320, an electrical connection structure 330, an encapsulant 340, a passive component 350, and a sub-substrate 410.

The connection member 200 may have a structure similar to that of the connection members described with reference to FIGS. 1 to 10B.

The IC 310 may be the same as the IC described above, and may be disposed in a position lower than a position of the connection member 200. The IC 310 may be electrically connected to a wiring of the connection member 200 to transmit or receive an RF signal, and may be electrically connected to the ground layer of the connection member 200 to receive a ground. For example, the IC 310 may perform at least a portion of frequency conversion, amplification, filtering, phase control, and power generation to produce a converted signal.

The adhesive member 320 may bond the IC 310 and the connection member 200 to each other.

The electrical connection structure 330 may electrically connect the IC 310 and the connection member 200 to each other. For example, the electrical connection structure 330 may have a structure such as a solder ball, a pin, a land, and a pad. The electrical connection structure 330 has a melting point lower than that of the wiring and the ground layer of the connection member 200, such that the IC 310 and the connection member 200 may be electrically connected through a predetermined process using the low melting point.

The encapsulant 340 may encapsulate at least a portion of the IC 310, and may improve the heat radiation performance and the shock protection performance of the IC 310. For example, the encapsulant 340 may be implemented with a photo-imagable encapsulant (PIE), Ajinomoto build-up film (ABF), epoxy molding compound (EMC), or the like.

The passive component 350 may be disposed on the lower surface of the connection member 200, and may be electrically connected to the wiring and/or ground layer of the connection member 200 through the electrical connection structure 330. For example, the passive component 350 may include at least a portion of a capacitor (e.g., a multilayer ceramic capacitor (MLCC)), an inductor, or a chip resistor.

The sub-substrate 410 may be disposed in a position lower than a position of the connection member 200, and may be electrically connected to the connection member 200 to receive an intermediate frequency (IF) signal or a baseband signal from the outside and transmit the signal to the IC 310, or receive an IF signal or a baseband signal from the IC 310 and transmit the signal to the outside. In this case, a frequency of the RF signal (for example, 24 GHz, 28 GHz, 36 GHz, 39 GHz, and 60 GHz) may be higher than a frequency of the IF signal (for example, 2 GHz, 5 GHz and 10 GHz).

For example, the sub-board 410 may transmit an IF signal or a baseband signal to the IC 310, or may receive the signal from the IC 310 through a wiring that may be included in the IC ground layer of the connection member 200. Since the first ground layer of the connection member 200 is disposed between the IC ground layer and the wiring, the IF signal or the baseband signal and the RF signal may be electrically isolated in the antenna apparatus.

Referring to FIG. 11B, an antenna apparatus, according to an embodiment, may include at least a portion of a shield member 360, a connector 420, and a chip antenna 430.

The shield member 360 may be disposed in a position lower than a position of a connection member 200, and may be disposed to confine the IC 310 in association with the connection member 200. For example, the shield member 360 may be arranged to cover (e.g., conformally shield) the IC 310 and the passive components 350 together, or cover (e.g., compartmentally shield) the IC 310 and the passive components 350, respectively. For example, the shield member 360 may have a hexahedral shape with one surface open, and may have a receiving space of a hexahedron through coupling with the connection member 200. The shield member 360 may be formed of a material having high conductivity such as copper to have a relatively shallow skin depth, and may be electrically connected to the ground layer of the connection member 200. Therefore, the shield member 360 may reduce the electromagnetic noise from which the IC 310 and the passive component 350 may receive.

The connector 420 may have a connection structure of a cable (e.g., a coaxial cable, a flexible PCB), may be electrically connected to the IC ground layer of the connection member 200, and may have a function similar to that of the above described sub-substrate. For example, the connector 420 may be provided with an IF signal, a baseband signal, and/or power from the cable, or may provide an IF signal and/or a baseband signal to the cable.

The chip antenna 430 may transmit or receive an RF signal to assist the antenna apparatus. For example, the chip antenna 430 may include a dielectric block having a dielectric constant greater than that of the insulating layer, and electrodes disposed on both surfaces of the dielectric block. One of the electrodes may be electrically connected to the wiring of the connection member 200, and another of the electrodes may be electrically connected to the ground layer of the connection member 200.

Figure 12A:
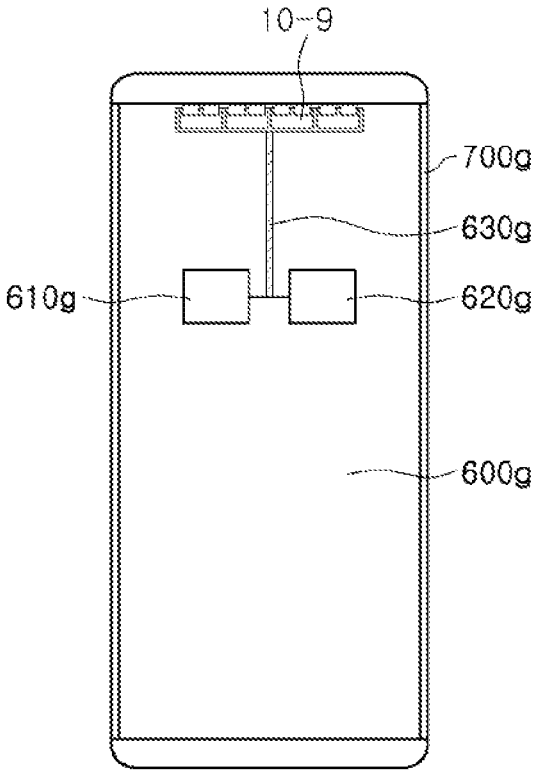
FIGS. 12A and 12B are plan views illustrating an arrangement of an antenna apparatus in an electronic device, according to an embodiment.
Figure 12B:
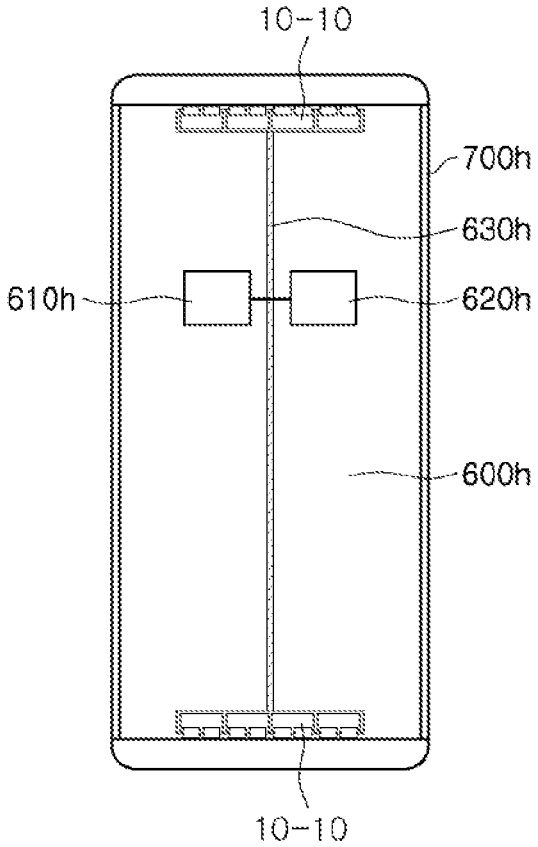

FIGS. 12A and 12B are plan views illustrating arrangements of antenna apparatuses in electronic devices, according to embodiments.

Referring to FIG. 12A, an antenna apparatus 10-9 may be disposed adjacent to a lateral boundary of an electronic device 700*g* on a set substrate 600*g* of the electronic device 700*g*.

The electronic device 700*g* may a smartphone, a personal digital assistant, a digital video camera, a digital still camera, a network system, a computer, a monitor, a tablet, a laptop, a netbook, a television, a video game, a smartwatch, an automotive, or the like, but is not limited to the aforementioned examples.

A communications module 610*g* and a baseband circuit 620*g* may be further disposed on the set substrate 600*g*. The antenna apparatus 10-9 may be electrically connected to a communications module 610*g* and/or a baseband circuit 620*g* through a coaxial cable 630*g*.

The communications module 610*g* may include at least a portion of a memory chip, such as a volatile memory (e.g., a DRAM), a non-volatile memory (e.g., a ROM), a flash memory, and the like; an application processor chip, such as a central processing unit (e.g., a CPU), a graphics processing unit (e.g., a GPU), a digital signal processor, a cryptographic processor, a microprocessor, a microcontroller, and the like; a logic chip, such as an analog-to-digital converter, an application-specific IC (ASIC), and the like, to perform a digital signal process.

The baseband circuit 620*g* may perform an analog-to-digital conversion, amplification in response to an analog signal, filtering, and frequency conversion to generate a base signal. The base signal input/output from the baseband circuit 620*g* may be transferred to the antenna apparatus 10-9 through a cable.

For example, the base signal may be transferred to the IC through an electrical connection structure, a core via, and a wiring. The IC may convert the base signal into an RF signal in a millimeter wave (mmWave) band.

Referring to FIG. 12B, antenna apparatuses 10-10 may be disposed adjacent to one side surface and the other side surface of an electronic device 700*h* on a set substrate 600*h* of the electronic device 700*h*, On the set substrate 600*h*, a communications module 610*h* and a baseband circuit 620*h* may be further disposed. The antenna apparatuses 10-10 may be electrically connected to the communications module 610*h* and/or the baseband circuit 620*h* through a coaxial cable 630*h*.

The antenna structures, the feed vias, the ground layers, and the shield structures disclosed herein may include a metallic material (e.g., a conductive material, such as copper (Cu), aluminum (Al), silver (Ag), tin (Sn), gold (Au), nickel (Ni), lead (Pb), titanium (Ti), alloys thereof, or the like), and may be formed according to plating methods such as a chemical vapor deposition (CVD), a physical vapor deposition (PVD), a sputtering, a subtractive, an additive, a semi-additive process (SAP), a modified semi-additive process (MSAP), and the like, but are not limited to these examples.

In addition, an the antenna apparatus according to an embodiment, at least a portion of the space in which the antenna structure, the feed via, the ground layer, and the shield structure are not disposed may be filled with an insulating layer. The insulating layer may be implemented with a thermosetting resin such as FR4, liquid crystal polymer (LCP), low temperature co-fired ceramic (LTCC), epoxy resin, or a thermoplastic resin such as polyimide, or a resin impregnated into core materials such as glass fiber, glass cloth and glass fabric together with inorganic filler, prepregs, Ajinomoto build-up film (ABF), FR-4, bismaleimide triazine (BT), photosensitive insulation imagable dielectric (PID) resin, a copper clad laminate (CCL), a glass or ceramic based insulating material, or the like.

The RF signals disclosed herein may have a format according to Wi-Fi (IEEE 802.11 family), WiMAX (IEEE 802.16 family), IEEE 802.20, long term evolution (LTE), Ev-DO, HSPA+, HSDPA+, HSUPA+, EDGE, GSM, GPS, GPRS, CDMA, TDMA, DECT, Bluetooth, 3G, 4G, 5G, and any other wireless and wired protocols designated as the later thereof, but are not limited to these examples.

An antenna apparatus, according to an embodiment, may integrate the antenna for the first direction transmission/reception and the antenna for the second direction transmission/reception, thereby reducing the number, length, and complexity of the feed lines connected to the antenna, and may further have a component advantageous to antenna performance without substantial increase in size in comparison to conventional antenna apparatuses.

An antenna apparatus, according to an embodiment, may transmit and receive RF signals in the first and second directions without any separate design for electromagnetic isolation between the antenna for the first direction transmission and reception and the antenna for the second direction transmission and reception. Therefore, a component advantageous to the antenna performance may be additionally provided, without reducing the size or substantially increasing the size of the antenna apparatus, while maintaining the antenna performance.

The communications modules 610*g* and 610*h* in FIGS. 12A and 12B, respectively, that perform the operations described in this application are implemented by hardware components configured to perform the operations described in this application that are performed by the hardware components. Examples of hardware components that may be used to perform the operations described in this application where appropriate include controllers, sensors, generators, drivers, memories, comparators, arithmetic logic units, adders, subtractors, multipliers, dividers, integrators, and any other electronic components configured to perform the operations described in this application. In other examples, one or more of the hardware components that perform the operations described in this application are implemented by computing hardware, for example, by one or more processors or computers. A processor or computer may be implemented by one or more processing elements, such as an array of logic gates, a controller and an arithmetic logic unit, a digital signal processor, a microcomputer, a programmable logic controller, a field-programmable gate array, a programmable logic array, a microprocessor, or any other device or combination of devices that is configured to respond to and execute instructions in a defined manner to achieve a desired result. In one example, a processor or computer includes, or is connected to, one or more memories storing instructions or software that are executed by the processor or computer. Hardware components implemented by a processor or computer may execute instructions or software, such as an operating system (OS) and one or more software applications that run on the OS, to perform the operations described in this application. The hardware components may also access, manipulate, process, create, and store data in response to execution of the instructions or software. For simplicity, the singular term "processor" or "computer" may be used in the description of the examples described in this application, but in other examples multiple processors or computers may be used, or a processor or computer may include multiple processing elements, or multiple types of processing elements, or both. For example, a single hardware component or two or more hardware components may be implemented by a single processor, or two or more processors, or a processor and a controller. One or more hardware components may be implemented by one or more processors, or a processor and a controller, and one or more other hardware components may be implemented by one or more other processors, or another processor and another controller. One or more processors, or a processor and a controller, may implement a single hardware component, or two or more hardware components. A hardware component may have any one or more of different processing configurations, examples of which include a single processor, independent processors, parallel processors, single-instruction single-data (SISD) multiprocessing, single-instruction multiple-data (SIMD) multiprocessing, multiple-instruction single-data (MISD) multiprocessing, and multiple-instruction multiple-data (MIMD) multiprocessing.

Instructions or software to control computing hardware, for example, one or more processors or computers, to implement the hardware components and perform the methods as described above may be written as computer programs, code segments, instructions or any combination thereof, for individually or collectively instructing or configuring the one or more processors or computers to operate as a machine or special-purpose computer to perform the operations that are performed by the hardware components and the methods as described above. In one example, the instructions or software include machine code that is directly executed by the one or more processors or computers, such as machine code produced by a compiler. In another example, the instructions or software includes higher-level code that is executed by the one or more processors or computer using an interpreter. The instructions or software may be written using any programming language based on the block diagrams and the flow charts illustrated in the drawings and the corresponding descriptions in the specification, which disclose algorithms for performing the operations that are performed by the hardware components and the methods as described above.

The instructions or software to control computing hardware, for example, one or more processors or computers, to implement the hardware components and perform the methods as described above, and any associated data, data files, and data structures, may be recorded, stored, or fixed in or on one or more non-transitory computer-readable storage media. Examples of a non-transitory computer-readable storage medium include read-only memory (ROM), random-access memory (RAM), flash memory, CD-ROMs, CD-Rs, CD+Rs, CD-RWs, CD+RWs, DVD-ROMs, DVD-Rs, DVD+Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, solid-state disks, and any other device that is configured to store the instructions or software and any associated data, data files, and data structures in a non-transitory manner and provide the instructions or software and any associated data, data files, and data structures to one or more processors or computers so that the one or more processors or computers can execute the instructions. In one example, the instructions or software and any associated data, data files, and data structures are distributed over network-coupled computer systems so that the instructions and software and any associated data, data files, and data structures are stored, accessed, and executed in a distributed fashion by the one or more processors or computers.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a ground layer;

a feed line disposed in a position lower in a vertical direction than a position of the ground layer; and an antenna structure comprising:

a first radiation part connected to one end of the feed line and configured to provide a first electromagnetic plane in a first direction, and a second radiation part connected to the first radiation part, configured to provide a second electromagnetic plane in a second direction, and disposed such that at least a portion of the second radiation part is disposed in a position higher in the vertical direction than the position of the ground layer and overlaps the ground layer in the vertical direction, wherein the first electromagnetic plane comprises stacked patterns stacked on each other and vias electrically connecting the stacked patterns to each other.

2. The antenna apparatus according to claim 1, further comprising a shield structure disposed in a position higher in the vertical direction than the position of the ground layer and laterally surrounding at least a portion of the second radiation part.

3. The antenna apparatus according to claim 2, wherein the shield structure comprises ground vias having first ends electrically connected to the ground layer, respectively, and a ground pattern electrically connected to second ends of the ground vias.

4. The antenna apparatus according to claim 2, wherein the shield structure has a U-shape in which a portion of the antenna structure is internally disposed.

5. The antenna apparatus according to claim 1, further comprising a second ground layer disposed in a position lower in the vertical direction than the position of the feed line, wherein the antenna structure further comprises a third radiation part connected to the first radiation part, configured to provide a third electromagnetic plane in a third direction, and disposed such that at least a portion of the third radiation part is disposed in a position lower in the vertical direction than the position of the second ground layer.

6. The antenna apparatus according to claim 5, further comprising a shield structure disposed in a position lower in the vertical direction than the position of the second ground layer and laterally surrounding at least a portion of the third radiation part.

7. The antenna apparatus according to claim 5, further comprising a sub-substrate providing a space configured to accommodate the third radiation part and a space configured to accommodate a portion of the first radiation part, wherein an area of an upper surface of the sub-substrate is less than an area of the ground layer.

8. The antenna apparatus according to claim 1, further comprising:

a second feed line disposed in a position lower in the vertical direction than the position of the ground layer; and a second antenna structure comprising:

a third radiation part connected to one end of the second feed line and configured to provide a third electromagnetic plane in the first direction, and a fourth radiation part connected to the third radiation part, configured to provide a fourth electromagnetic plane in the second direction, and disposed such that at least a portion of the fourth radiation part is located in a position higher in the vertical direction than the position of the ground layer, wherein the first radiation part and the third radiation part have structures extending in directions away from each other.

9. The antenna apparatus according to claim 8, further comprising a shield structure disposed in a position higher in the vertical direction than the position of the ground layer and laterally surrounding at least a portion of the second radiation part and at least a portion of the fourth radiation part, together.

10. The antenna apparatus according to claim 9, wherein a shortest distance between the shield structure and the second radiation part is shorter than ¼ of a wavelength of an RF signal transmitted and received by the antenna structure.

11. The antenna apparatus according to claim 10, wherein a shortest distance between the second radiation part and the fourth radiation part is shorter than a shortest distance between the shield structure and the second radiation part.

12. The antenna apparatus according to claim 10, wherein the second radiation part and the fourth radiation part each have a rectangular shape having a long side and a short side, and the long side of the second radiation part and the long side of the fourth radiation part form a virtual single straight line.

13. The antenna apparatus according to claim 8, wherein the antenna structure further comprises a fifth radiation part connected to the first radiation part, configured to provide a fifth electromagnetic plane in a third direction, and arranged such that at least a portion of the third radiation part is disposed in a position lower in the vertical direction than the position of the feed line, and the second antenna structure further comprises a sixth radiation part connected to the third radiation part, configured to provide a sixth electromagnetic plane in the third direction, and disposed such that at least a portion of the sixth radiation part is located in a position lower in the vertical direction than the position of the second feed line.

14. The antenna apparatus according to claim 8, further comprising:

a third feed line disposed in a position lower in the vertical direction than the position of the ground layer;

a third antenna structure comprising:

a fifth radiation part connected to one end of the third feed line and configured to provide a fifth electromagnetic plane in the first direction, and a sixth radiation part connected to the fifth radiation part, configured to provide a sixth electromagnetic plane in the second direction, and disposed such that at least a portion of the sixth radiation part is located in a position higher in the vertical direction than the position of the ground layer; and a shield structure disposed in a position higher in the vertical direction than the position of the ground layer, configured to laterally block at least a portion of the second radiation part and at least a portion of the sixth radiation part of the third antenna structure, and configured to laterally surround at least a portion of the second radiation part and at least a portion of the sixth radiation part, respectively.

15. The antenna apparatus of claim 1, further comprising a shield structure disposed in a position higher in the vertical direction than the position of the ground layer and having a U-shaped structure laterally surrounding three outer sides of the second radiation part.

16. The antenna apparatus of claim 8, further comprising a shield structure disposed in a position higher in the vertical direction than the position of the ground layer and having a U-shaped structure laterally surrounding two outer sides of each of the second radiation part and the fourth radiation part, together.

17. An antenna apparatus, comprising:

a first feed line;

a first antenna structure comprising:

a first radiation part connected to an end of the first feed line and configured to provide a first electromagnetic plane, and a second radiation part connected to the first radiation part, configured to provide a second electromagnetic plane perpendicular to the first electromagnetic plane; and a ground layer disposed in a position between a position of the first feed line in a first direction and a position of the second radiation part in the first direction, and having a surface in a plane parallel to the second electromagnetic plane, wherein the second radiation part overlaps the ground layer in the first direction, wherein the first direction is perpendicular to the second electromagnetic plane and the surface of the ground layer, and wherein the first electromagnetic plane comprises stacked patterns stacked on each other and vias electrically connecting the stacked patterns to each other.

18. The antenna apparatus according to claim 17, wherein the antenna apparatus further comprises a third radiation part connected to the first radiation part and configured to provide a third electromagnetic plane perpendicular to the first electromagnetic plane, and the position of the first feed line is between a position of the third radiation part and the position of the second radiation part in the first direction.

19. The antenna apparatus of claim 17, further comprising a shield structure at least partially surrounding the antenna apparatus in one or more planes perpendicular to the second plane.

20. The antenna apparatus of claim 17, further comprising:

a second feed line; and a second antenna structure spaced from the first antenna structure in a direction perpendicular to the first direction, and comprising:

a third radiation part connected to an end of the second feed line and configured to provide a third electromagnetic plane parallel to the first magnetic plane; and a fourth radiation part connected to the third radiation part configured to provide a fourth electromagnetic plane perpendicular to the third electromagnetic plane, wherein the position of the ground layer is between a position of the second feed line and a position of the fourth radiation part in the first direction.

21. An antenna apparatus, comprising:

a ground layer;

a feed line disposed in a position lower in a vertical direction than a position of the ground layer;

a second ground layer disposed in a position lower in the vertical direction than the position of the feed line; and an antenna structure comprising:

a first radiation part connected to one end of the feed line and configured to provide a first electromagnetic plane in a first direction, a second radiation part connected to the first radiation part, configured to provide a second electromagnetic plane in a second direction, and disposed such that at least a portion of the second radiation part is disposed in a position higher in the vertical direction than the position of the ground layer and overlaps the ground layer in the vertical direction, and a third radiation part connected to the first radiation part, configured to provide a third electromagnetic plane in a third direction, and disposed such that at least a portion of the third radiation part is disposed in a position lower in the vertical direction than the position of the second ground layer.

* * * * *